US009522462B2

(12) United States Patent
Baker et al.

(10) Patent No.: US 9,522,462 B2
(45) Date of Patent: Dec. 20, 2016

(54) FLANGE GASKET INSTALLATION APPARATUS AND METHOD

(71) Applicants: Robert Baker, Alpena, AR (US); Timothy J. Ogier, Alpena, AR (US)

(72) Inventors: Robert Baker, Alpena, AR (US); Timothy J. Ogier, Alpena, AR (US)

( * ) Notice: Subject to any disclaimer, the term of this patent is extended or adjusted under 35 U.S.C. 154(b) by 266 days.

(21) Appl. No.: 14/541,711

(22) Filed: Nov. 14, 2014

(65) Prior Publication Data

US 2016/0136796 A1 May 19, 2016

(51) Int. Cl.
*B25B 27/14* (2006.01)
*B25B 27/16* (2006.01)
*B25B 27/00* (2006.01)

(52) U.S. Cl.
CPC ..... *B25B 27/16* (2013.01); *B25B 27/0028* (2013.01)

(58) Field of Classification Search
USPC ... 29/244, 270, 271, 272, 278, 281.1; 269/3, 269/6, 95; 277/609, 612, 616
See application file for complete search history.

(56) References Cited

U.S. PATENT DOCUMENTS 3,620,554 A * 11/1971 Ward ..... F16L 1/26 277/609
4,002,344 A * 1/1977 Smith ..... F16L 23/003 277/609
5,590,474 A 1/1997 Lamb
8,025,080 B2 * 9/2011 Orleskie ..... G01F 1/42 138/44
2008/0056814 A1 3/2008 Klingenberg et al.
2011/0167607 A1 7/2011 Vidrine et al.

FOREIGN PATENT DOCUMENTS

WO WO 2007083203 7/2007

OTHER PUBLICATIONS

Wacker, Randy, "Manage & Understand Flange Face Damage"; Pumps & Systems, www.pump-zone.com; Jul. 2013; Published in: US.
Drago, Jim; "Focus on Maintenance: Causes &Costs of Gasket Failure" www.chem.info; Jun. 2008; Published in: US.
PCT/US2015/055208 International Search Report and Written Opinion; Dec. 30, 2015; US.

* cited by examiner

*Primary Examiner* — Joseph J Hail
*Assistant Examiner* — Shantese McDonald
(74) *Attorney, Agent, or Firm* — Dennis D. Brown; Brown Patent Law, P.L.L.C.

(57) ABSTRACT

A gasket retaining apparatus and a method which uses the apparatus to install a gasket between a pair of flanges. The retaining apparatus includes a gasket holding element which is temporarily secured between the flanges while joining the flanges together. A gasket groove is formed in the forward edge of the gasket holding element and one or more bolting slots extend into the body of the holding element from the forward edge. The gasket holding element preferably also includes a pair of retention holes so that a pair of releasable locking pins can be inserted through a pair of the bolt holes of one of the flanges and into the retention holes to temporarily secure the gasket holding element during the installation process.

15 Claims, 7 Drawing Sheets

FLANGE GASKET INSTALLATION APPARATUS AND METHOD

FIELD OF THE INVENTION

The present invention relates to apparatus and methods for installing gaskets in flanged piping systems for pipes, valves, other piping fixtures, and vessels.

BACKGROUND OF THE INVENTION

To prevent leakage and failure in flanged piping systems, flange sealing gaskets are used between pipe segments and are also used in the flanged connections for valves, other piping fixtures, and vessels. The most common type of piping flange used in plant and other applications is a raised face flange. The face of the raised face-type flange has an inner circular gasket contacting surface which is raised above (i.e., projects outwardly with respect to) a surrounding outer bolting circle. Depending upon the pressure classification of the flange, the projecting height of the raised face will typically be about 1.6 mm (1/16 inch) or 6.4 mm (1/4 inch). The purpose of the raised face is to concentrate more pressure on a smaller gasket area and thereby increase the pressure containment capability of the flanged joint.

Raised face flanges accommodate the use of a wide variety of gasket designs. Examples of such gasket designs include, but are not limited to, flat ring sheet gaskets, spiral wound gaskets, gaskets with circular face serrations, and double jacketed gaskets. Many gaskets include (a) a circular inner portion which is spiral wound, serrated, or otherwise formed for sealing contact and has a radial width which is preferably substantially equal to or slightly greater than the radial width of the raised face of the flange and (b) an outer circular portion which surrounds that circular inner portion of the gasket and fits within the bolt circle of the flange when installed.

Although flange gaskets often represent a minor portion of the overall cost of a piping system, the consequences of a gasket failure can sometimes include fires, explosions, releases of hazardous chemicals, and/or other catastrophes. Such catastrophic failures can result in significant repair costs, lost production, fines, downtime, damage to the environment, and even death or serious personal injury.

Unfortunately, flange gaskets are difficult to manage and hold in place when joining pipe segments, installing valves, etc. Workers attempting to hold the gaskets in place by hand can be seriously injured. In this same regard, the gaskets themselves can also be easily scratched, gouged, or dented, for example, when accidentally impacted by tools or when subjected to collisions which can occur when attempting to position and align mating flanges using cables and rigging or by other means.

When the gasket is damaged in this manner, it must often be discarded and replaced, thus slowing and increasing the cost of the installation process. Moreover, in many cases such damage is not observed or is otherwise missed during installation and may result in leakage or catastrophic failure.

In an attempt to protect workers from injuries and to better align and protect the flange gaskets, caulks, glues or other substances are sometimes used to hold flange gaskets in place during the installation process. However, these substances can also damage the gasket or cause other problems which may result in gasket failure. For example, caulks and other substances often contain acidic components or other materials which are not compatible with the gasket and can cause the gasket to corrode over time. Also, because of their lubricity, caulks and other substances can cause the gasket to shift within the flange if contacted, pushed, or squeezed during installation or during the bolt tightening process. Glues, on the other hand, require significant time to apply and dry properly and can interfere with sealing effectiveness of the gasket.

As will therefore be apparent, a need currently exists for a more effective means of retaining a flange gasket when joining pipe segments, installing valves, attaching lines to vessels, etc. The improved means for retaining the flange gasket will preferably be hands free and will also preferably: (a) prevent worker injuries, (b) protect the gasket from damaging impacts and collisions, (c) accelerate the installation process, (d) eliminate the need to apply caulks, glues, or other substances, and (e) ensure that the positioning and alignment of the gasket flange are properly and precisely maintained during installation.

SUMMARY OF THE INVENTION

The present invention provides an apparatus and method which satisfy the needs and alleviate the problems discussed above.

In one aspect, there is provided an apparatus for retaining a flange gasket in position between mating flanges during attachment. The apparatus comprises a holding element having: (a) a rearward edge and a forward edge; (b) a gasket groove in the forward edge for receiving an outer portion of the flange gasket, the gasket groove extending rearwardly into the holding element from the forward edge; (c) at least one bolting slot which extends rearwardly into the holding element from the forward edge and has an open forward end at the forward edge; and (d) a pair of retention holes on opposite sides of the bolting slot. The bolting slot and the retention holes extend entirely through the holding element in a transverse direction perpendicular to the gasket groove. In addition, the retention holes and the bolting slot are positioned in the holding element for simultaneous alignment with a corresponding number of bolt holes in a flange of a pipe, valve, other piping fixture, or vessel.

In another aspect, there is provided a method of connecting a second flange to a first flange. The method comprises the steps of:

a) temporarily securing a gasket holding element on a face of the first flange such that the gasket holding element holds a flange gasket in proper alignment with the face of the first flange for installation of the flange gasket between the face of the first flange and a corresponding face of the second flange, wherein the first flange and the second flange each have a plurality of corresponding bolt holes and the gasket holding element comprises:
   - a gasket groove in a forward edge of the gasket holding element in which an outer portion of the flange gasket is received and
   - at least one bolting slot which extends rearwardly into the gasket holding element from the forward edge, the bolting slot having an open forward end at the forward edge and the bolting slot extending entirely through the gasket holding element in a transverse direction perpendicular to the gasket groove,
   - wherein in step (a) the bolting slot is positioned in alignment with one of the bolt holes of the first flange;

b) aligning the face of the second flange with the face of the first flange so that the gasket holding element and the flange gasket are positioned between the face of the first flange and the face of the second flange and the bolt holes of the second flange are in alignment with the bolt holes of the first flange so that one of the bolt holes of the second flange is in alignment with the bolting slot of the gasket holding element and with said one of the bolt holes of the first flange;

c) inserting a first bolt through said one of the bolt holes of the first flange, the bolting slot of the gasket holding element, and said one of the bolt holes of the second flange;

d) inserting at least one other bolt through at least one other corresponding pair of bolt holes of the first and the second flanges; and e) releasing the gasket holding element and removing the gasket holding element from between the faces of the first and the second flanges to leave the flange gasket between the face of the first flange and the face of the second flange.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
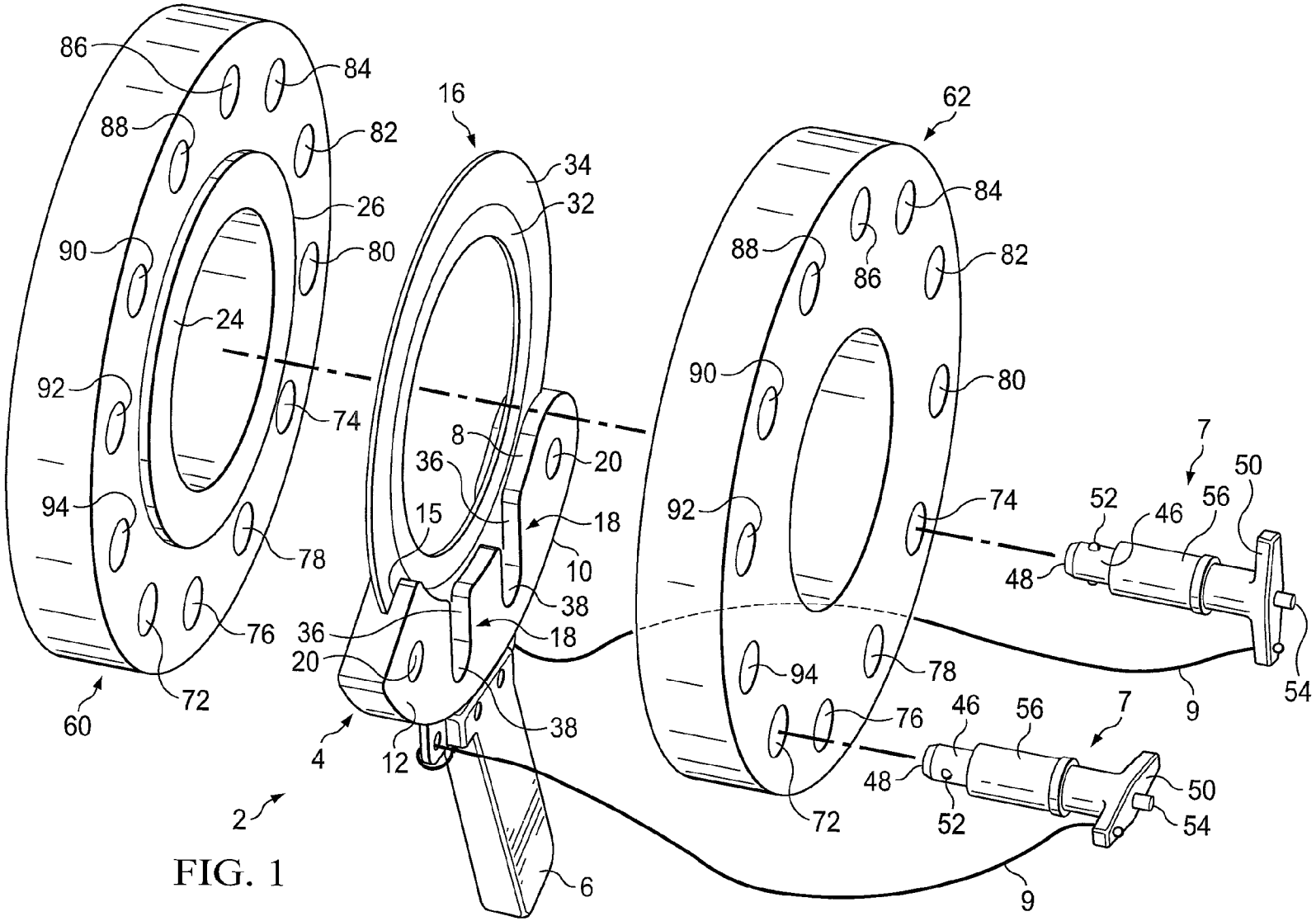
FIG. 1 is an exploded perspective view illustrating the use of an embodiment 2 of the inventive gasket retaining apparatus in the installation of a flange gasket 16 between a pair of flanges 60 and 62.

An embodiment 2 of the inventive gasket retaining apparatus is illustrated in FIGS. 1-5. The inventive gasket retaining apparatus 2 preferably comprises: a gasket holding element 4; a handle 6 which extends from the gasket holding element 4; a pair of locking pins 7; and cords, cables or other tethers 9 which extend from the gasket holding element 4 or the handle 6 to the locking pins 7 for retaining the locking pins 7 with the apparatus 2 when the locking pins 7 are not engaged. The gasket holding element 4 can be sized and configured to match the diameter, and to match the number, size, and spacing of the bolt holes, of the flanges used for any diameter of pipe.

The gasket holding element 4 preferably comprises: a forward edge 8; a rearward edge 10; a first flat side surface 12 which extends from the rearward edge 10 to the forward edge 8; a second flat side surface 14 which extends from the rearward edge 10 to the forward edge 8 and is spaced apart from and parallel to the first side surface 12; a gasket groove 15 in the forward edge 8 for receiving and holding the flange gasket 16 during the flange coupling operation, the gasket groove 15 being positioned between and parallel to the first and second side surfaces 12 and 14; one or a plurality of bolting slots 18 which extend rearwardly into the body of the holding element 4 in direction 39 (see FIG. 4) from the forward edge 8 toward the rearward edge 10; and a pair of retention holes 20 which extend through the body of the gasket holding element 4 on opposite sides of the one or more bolting slots 18. If more than one bolting slot 18 is used, the bolting slots 18 will be parallel.

For a raised face flange, the thickness (width) of the gasket holding element 4 of the inventive apparatus 2 in the transverse direction 33 (see FIG. 5) from the side surface 12 to the parallel side surface 14 will be determined by the combined width of (a) the two raised faces 24 of the opposing flanges 60 and 62 and (b) the width of the gasket 16. Most preferably, the width of the gasket holding element 4 in the transverse direction 33 will be slightly greater than the combined width of the two raised faces 24 and the gasket 16 in order to prevent damage to the gasket 16.

The positioning and spacing of the one or more bolting slots 18 and the retention holes 20 are such that the bolting slot(s) 18 will align with the bolt holes 76 and 78 of the flanges 60 and 62 during use and the retention holes 20 will simultaneously align with the flange bolt holes 72 and 74. The number of bolting slots 18 included in the gasket holding element 4 will preferably increase as the size of the flange increases. The number of bolting slots 18 used in the gasket holding element 4 will also preferably be an even number (i.e. 2, 4, 6, etc. as the size of the flange increases).

The forward edge 8, the rearward edge 10, and the gasket groove 15 of the gasket holding element 4 are preferably semicircular. For use with raised face flanges 24, the radius of curvature of the forward edge 8 will be greater than that of the outer edge 26 of the raised face 24 such that the forward edge 8 of the gasket holding element 4 will preferably be positioned outside of but adjacent to the outer edge 26 of the raised face 24.

Also, regardless of the type of flange in question, the radius of curvature and position of the forward edge 8 of the gasket holding element 4, as well the depth of the gasket groove 15, will preferably be such that the gasket holding element 4 will retain the gasket 16 in proper sealing alignment with the gasket contacting surfaces of the flanges 60 and 62. In addition, in the case of a two part gasket 16 having an inner sealing portion 32 surrounded by an outer portion 34, the gasket holding element 4 preferably will not cover any portion of the inner sealing portion 32.

The one or more bolting slots 18 each have an open forward end 36 in the forward edge 8 of the gasket holding element 4. Each bolting slot 18 also preferably: (a) extends entirely through the body of the holding element 4 in the transverse direction 33 (see FIG. 5) which is perpendicular to the first and second side surfaces 12 and 14 and the gasket groove 15; (b) has a lateral width in the direction 37 (see FIG. 4) parallel to the side surfaces 12 and 14 and the gasket groove 15 which is preferably equal to or slightly greater than the diameter of the bolt holes 72-94 of the flanges 60 and 62; (c) has a rounded, semicircular rearward end 38; (d) has a rearward depth in the direction 39 (see FIG. 4) such that a rearward-most portion 40 of the bolting slot 18 extends beyond the depth of the gasket groove 15 by a distance which is substantially equal to or greater than the diameter of the bolt holes 72-94 of the flanges 60 and 62.

When in use, the rearward-most portion 40 of each bolting slot 18 will be positioned between and in alignment with the mating the bolt holes 76 or the mating bolt holes 78 of the two flanges 60 and 62 such that, when a flange bolt 96 is inserted through the bolt holes 76 or the bolt holes 78 and the rearward-most portion 40 of the bolting slot 18, the bolt 96 will preferably be either in only slight contact or in very near contact with the outer edge of the gasket 16.

The pair of retention holes 20 in the gasket holding element 4 also extend transversely in direction 33 (see FIG. 5) through the body of the gasket holding element 4 and are preferably positioned on opposite sides of the bolting slots 18 for alignment with bolt holes 72 and 74 of the flange 62. The retention holes 20 can be substantially the same diameter as or smaller than the flange bolt holes 72 and 74. The retention holes 20 will preferably be slightly smaller than the bolt holes 72 and 74 so that the locking pins 7 which are inserted into the retention holes 20 as described below will not contact or interfere with the gasket 16 positioned in the gasket groove 15.

Each of the locking pins 7 preferably comprises: a cylindrical shaft 46 having a rounded or beveled insertion end 48; a handle or grip 50 on the outer end of the shaft 46; one or more (preferably two) detent balls or other detent elements 52 which retractably project from the shaft 46 near the insertion end 48 thereof; a spring or other biasing element or mechanism (not shown) within the shaft 46 for biasing the detent elements 52 toward, and holding the biasing elements in, their projecting locking positions; and a push button or other mechanism 54 linked to the internal biasing element or mechanism for retracting and releasing the detent elements 52 from their projecting locking positions. For releasably locking the insertion ends 48 of the locking pins 7 in the retention holes 20 of the gasket holding element 4, annular grooves or other features (not shown) for receiving the retention elements 52 are preferably provided in the retention holes 20.

The insertion shafts 46 of the locking pins 7 are sized to be received in the retention holes 20 which, as discussed above, preferably have a smaller diameter than the bolt holes 72 and 74 of the flange 62. The length of the insertion shafts 46 of the locking pins 7 is preferably such that the insertion shafts 46 can be inserted through bolt holes 72 and 74 of flange 62 and into a retention hole 20 of the gasket holding element 4 without extending beyond, or significantly beyond, the retention hole 20. To accommodate the preferred smaller diameter of the insertion shafts 46 of the locking pins 7 when inserting the locking pins 7 through the bolt holes 72 and 74 of the flange 62, cylindrical sleeves 56 matching the inside diameter of the bolt holes 72 and 74 are preferably inserted into the flange bolt holes 72 and 74 for receiving the locking pins 7.

The use of the inventive gasket retaining apparatus 2 for installing the flange gasket 16 when joining flange 60 to flange 62 is illustrated in FIGS. 1-6. By way of example, but not my way of limitation, flange 60 and flange 62 can each be either a flange of a pipe 64, a flange of a valve 66, a flange of any other type of piping fixture, or a flange of a vessel (e.g., a tank, tower, reactor, exchanger, separator, filter, purifier, or any other type of vessel).

Figure 2:
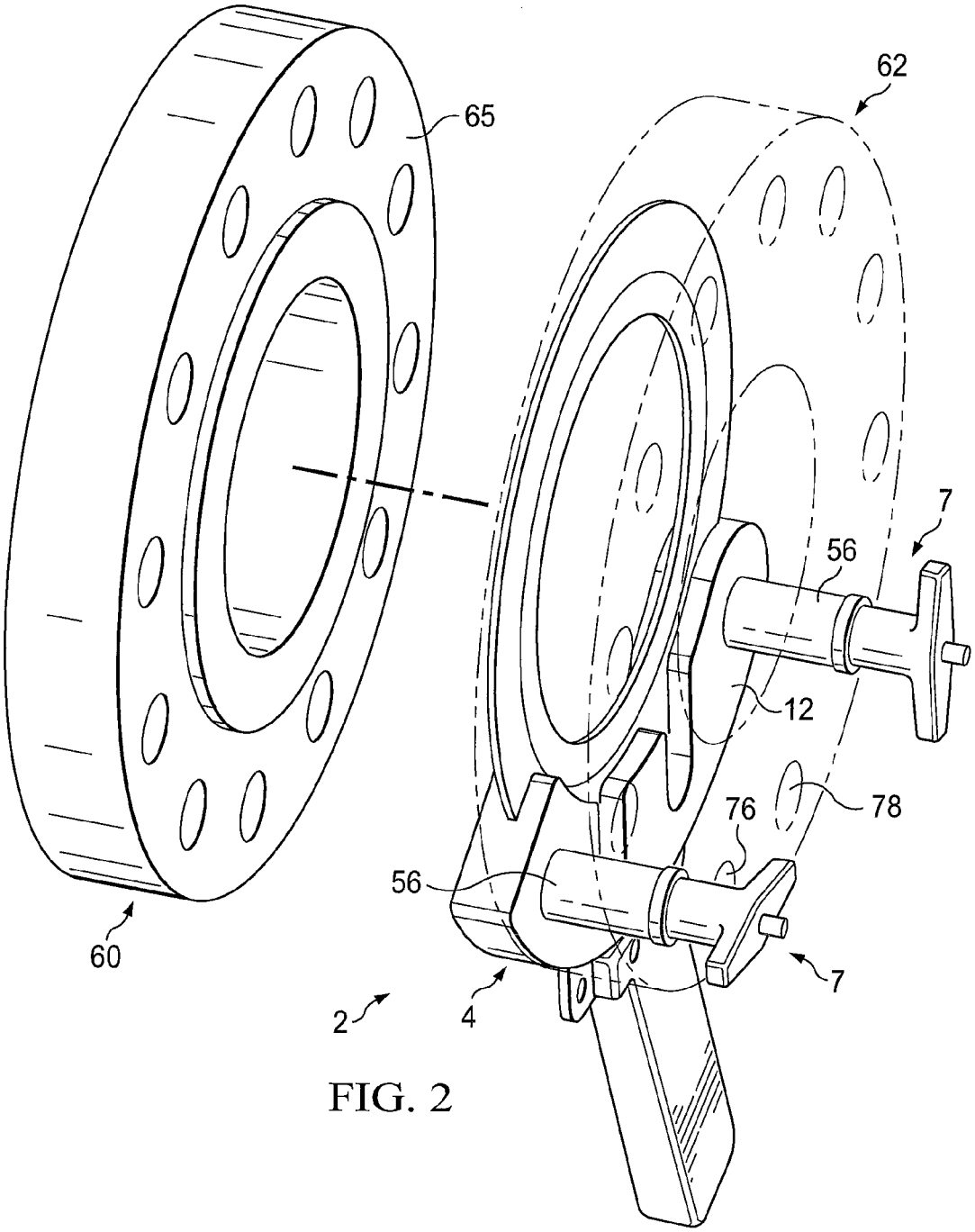
FIG. 2 is a perspective view illustrating the temporary attachment of the inventive gasket retaining apparatus 2 to the flange 62.

In the inventive installation method, the gasket 16 is placed in the gasket groove 15 of the retaining apparatus 2. The flat side surface 12 of the gasket holding element 4 of the apparatus 2 is then placed against the attachment face 63 of the flange 62 as illustrated in FIG. 2 such that: (a) the forward edge 8 of the holding element 4 is outside of (e.g., below) and adjacent to the circular outer edge 68 of the raised face 70 of the flange 62; (b) the retention holes 20 of the holding element 4 are in alignment with the bolt holes 72 and 74 of the flange 62; and (c) the rearward end portions 40 of the bolting slots 18 of the holding element 4 are in alignment with bolt holes 76 and 78 of the flange 62.

Next, the locking pin sleeves 56 are either (a) placed (or maintained) on the locking pins 7 or (b) placed in the bolt holes 76 and 78 of the flange 62. The locking pins 7 are then inserted through flange bolt holes 76 and 78 and into the retention holes 20 of the gasket holding element 4. As the insertion ends 48 of the locking pins 7 travel into the retention holes 20 and the detent elements 52 of the locking pins 7 reach the grooves or other detent receiving features within the retention holes 20, the detent elements 52 automatically move outwardly into engagement with the retaining features, thereby releasably securing the gasket holding element 4 of the inventive apparatus 2 on the attachment face 63 of the flange 62.

It will be understood, however, that other mechanisms and methods can alternatively be used to temporarily secure the gasket holding element 4 of the inventive apparatus 2 on the attachment face 63 of the flange 62.

Figure 3:
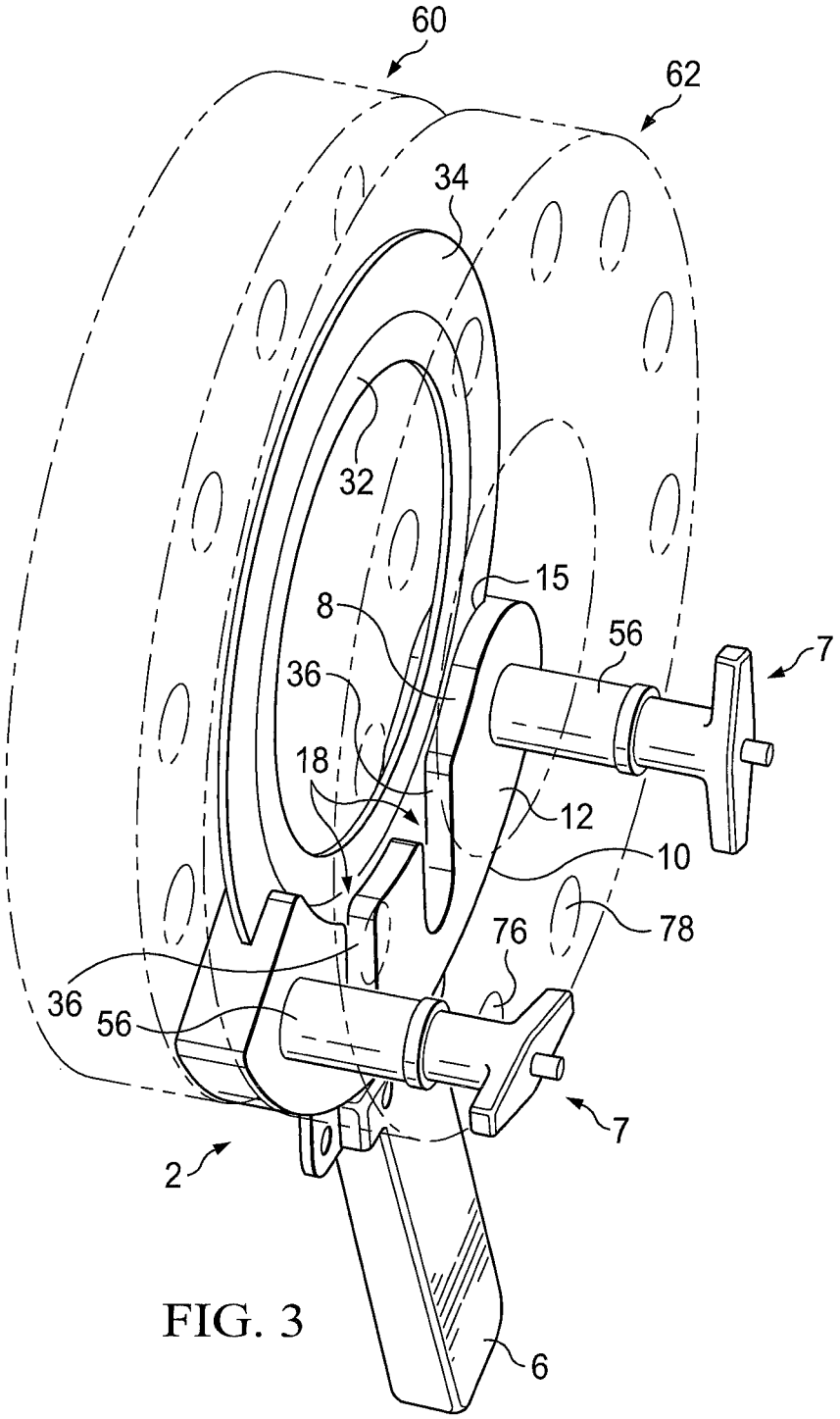
FIG. 3 is a perspective view illustrating the temporary attachment of the inventive gasket retaining apparatus 2 between the flange 62 and the flange 60.
Figure 4:
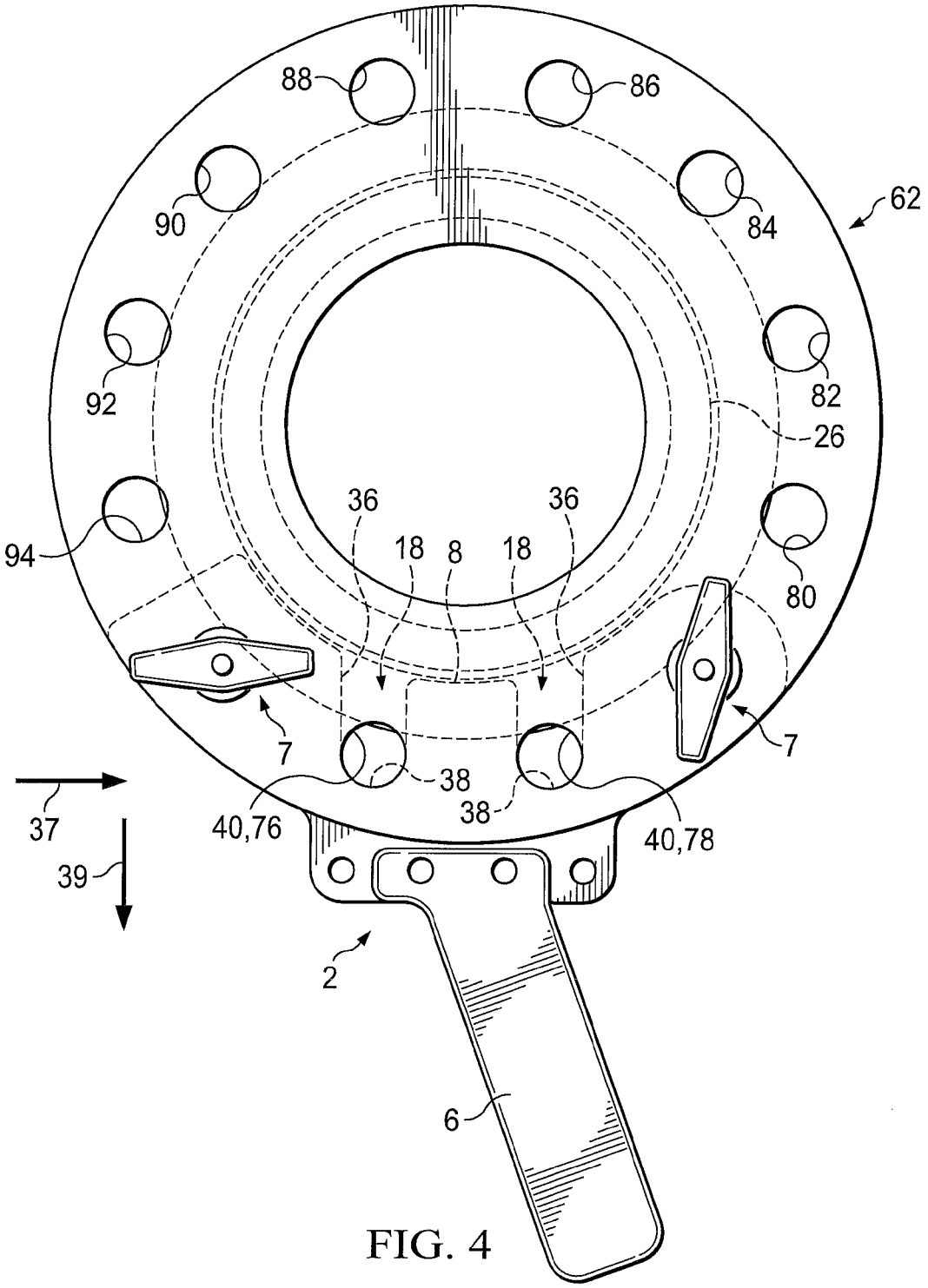
FIG. 4 is an elevational front view illustrating the temporary attachment of the inventive gasket retaining apparatus 2 between the flange 62 and the flange 60.
Figure 5:
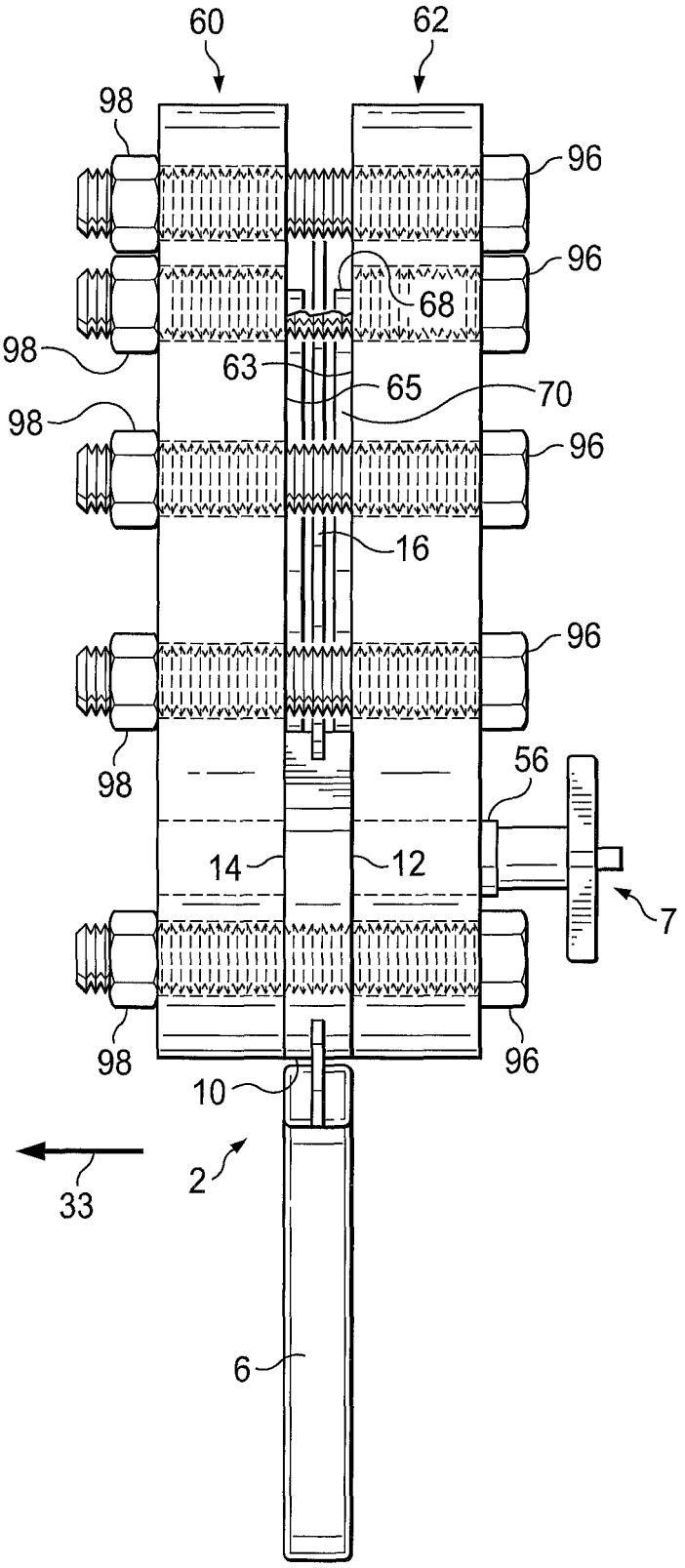
FIG. 5 is an elevational side view illustrating the temporary attachment of the inventive gasket retaining apparatus 2 between the flange 62 and the flange 60.
Figure 6:
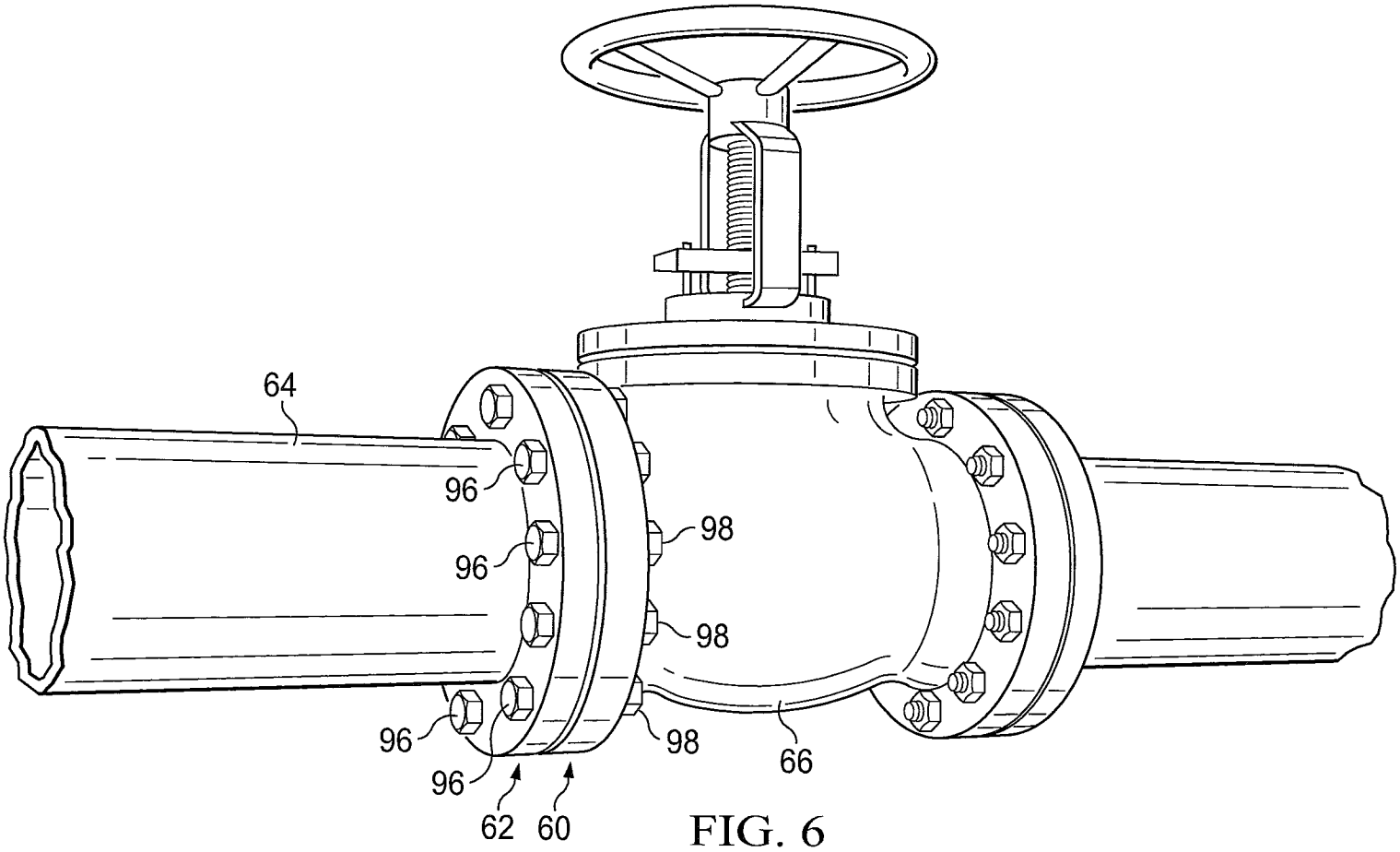
FIG. 6 illustrates the completed flange assembly wherein, by way of example but not by way of limitation, the flange 62 is a flange of a pipe 64 and the flange 60 is a flange of a valve 66.

Next, the attachment face 65 of the flange 60 is placed against or immediately adjacent to the other flat side surface 14 of the apparatus holding element 4 such that the bolt holes 72, 74, 76, 78, 80, 82, 84, 86, 88, 90, 92, and 94 of the flange 60 are in alignment with the corresponding bolt holes 72, 74, 76, 78, 80, 82, 84, 86, 88, 90, 92, and 94 of flange 62 as illustrated in FIGS. 3-5. A pair of bolts 96 are then inserted all of the way through the bolt holes 76 and 78 of flange 62, the bolting slots 18 of the gasket retaining apparatus 2, and the bolt holes 76 and 78 of flange 60. In addition, bolts 96 are also inserted through the corresponding bolt holes 80-94 of the flanges 62 and 60. Nuts 98 are then placed on the bolts 96 and preferably tightened to a degree that the flanges 60 and 62 will be held closely together but the attachment will not be so tight as to prevent the gasket retaining apparatus 2 from being removed.

Subsequently, the buttons or other release mechanisms 54 of the locking pins 7 are activated and the locking pins 7 and the pin sleeves 56 are removed. The gasket retaining apparatus 2 is then pulled outwardly in direction 39 (see FIG. 4) to thereby remove the gasket retaining apparatus 2 from between the flanges 60 and 62 but leave the flange gasket 16 in proper position between the flanges 60 and 62 within the flange bolting circle. In addition, as the retaining apparatus 2 is pulled outwardly in the direction 39, the bolts 96 which were previously inserted through the bolting slots 18 remain in fixed position so that the bolts 96 slide out of the open forward ends 36 of the bolting slots 36 and remain in the bolt holes 76 and 78 of the flanges 60 and 62.

Next, two additional bolts 96 are inserted through the corresponding bolt holes 72 of the flanges 62 and 60 and the corresponding bolt holes 74 of the flanges 62 and 60 (i.e., the bolt holes 72 and 74 where the locking pins 7 were previously located). Nuts 98 are then placed on the two additional bolts 96 and all of the bolts 96 are tightened until the flanges 62 and 60 are securely joined and the gasket is sealingly installed therebetween.

Figure 7:
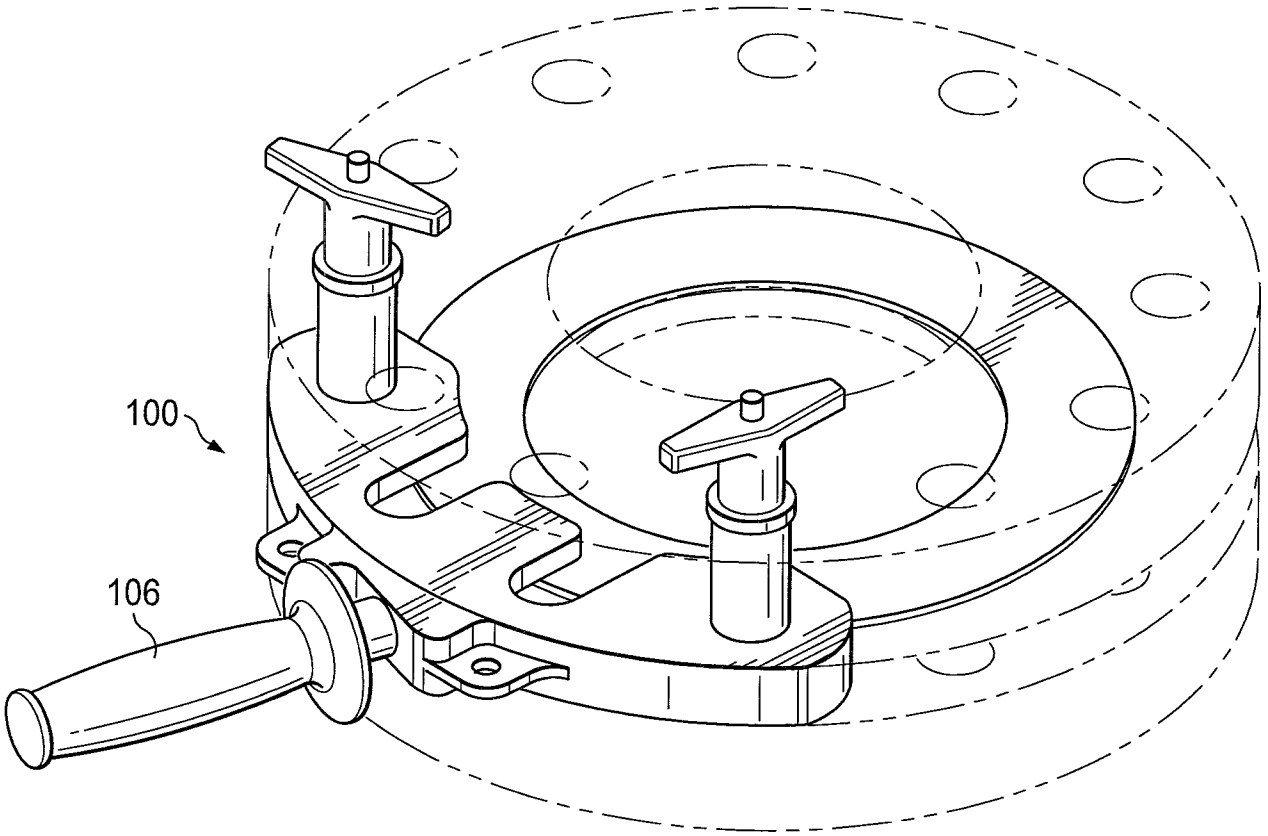
FIG. 7 is a perspective view illustrating the use of an alternative embodiment 100 of the inventive gasket retaining apparatus.

An alternative embodiment 100 of the inventive flange retaining apparatus having a different type of handle 106 is illustrated in FIG. 7.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. An apparatus for retaining a flange gasket in position between mating flanges during attachment, the apparatus comprising a holding element having:

a rearward edge and a forward edge;

a gasket groove in the forward edge for receiving an outer portion of a flange gasket, the gasket groove extending rearwardly into the holding element;

at least one bolting slot which extends rearwardly into the holding element from the forward edge, the bolting slot having an open forward end at the forward edge and the bolting slot extending entirely through the holding element in a transverse direction perpendicular to the gasket groove; and a pair of retention holes which also extend entirely through the holding element in the transverse direction, wherein the retention holes and the bolting slot are positioned in the holding element for simultaneous alignment with a corresponding number of bolt holes in a flange of a pipe, valve, other piping fixture, or vessel.

2. The apparatus of claim 1 further comprising a pair of locking pins sized for releasably attaching the holding element to the flange of the pipe, valve, other piping fixture, or vessel by insertion of the locking pins through two of the bolt holes of the flange and into the pair of retention holes of the holding element.

3. The apparatus of claim 2 wherein the locking pins each include a detent element for releasable locking engagement in the pair of retention holes.

4. The apparatus of claim 2 wherein:

the apparatus further comprises a pair of locking pin sleeves for positioning in the two bolt holes of the flange of the pipe, valve, other piping fixture, or vessel and the pair of locking pins are insertable through the pair of locking pin sleeves.

5. The apparatus of claim 4 wherein the retention holes have a diameter which is smaller than a diameter of the bolt holes of the flange of the pipe, valve, other piping fixture, or vessel.

6. The apparatus of claim 1 wherein the forward edge is semicircular.

7. The apparatus of claim 1 further comprising a handle extending from the rearward edge.

8. The apparatus of 7 wherein the rearward edge and the forward edge are semicircular.

9. The apparatus of claim 1 comprising at least two of the bolting slots, wherein each of the bolting slots extends rearwardly into the holding element from the forward edge, the bolting slots are parallel, each of the bolting slots has an open forward end at the forward edge, and each of the bolting slots extends entirely through the holding element in the transverse direction perpendicular to the gasket groove.

10. A method of connecting a second flange to a first flange comprising the steps of:

a) temporarily securing a gasket holding element on a face of the first flange such that the gasket holding element holds a flange gasket in proper alignment with the face of the first flange for installation of the flange gasket between the face of the first flange and a corresponding face of the second flange, wherein the first flange and the second flange each have a plurality of corresponding bolt holes and the gasket holding element comprises:

a gasket groove in a forward edge of the gasket holding element in which an outer portion of the flange gasket is received and at least one bolting slot which extends rearwardly into the gasket holding element from the forward edge, the bolting slot having an open forward end at the forward edge, and the bolting slot extending entirely through the gasket holding element in a transverse direction perpendicular to the gasket groove, wherein in step (a) the bolting slot is positioned in alignment with one of the bolt holes of the first flange;

b) aligning the face of the second flange with the face of the first flange so that the gasket holding element and the flange gasket are positioned between the face of the first flange and the face of the second flange and the bolt holes of the second flange are in alignment with the bolt holes of the first flange so that one of the bolt holes of the second flange is in alignment with the bolting slot of the gasket holding element and with said one of the bolt holes of the first flange;

c) inserting a first bolt through said one of the bolt holes of the first flange, the bolting slot of the gasket holding element, and said one of the bolt holes of the second flange;

d) inserting at least one other bolt through at least one other corresponding pair of bolt holes of the first and the second flanges; and e) releasing the gasket holding element and removing the gasket holding element from between the faces of the first and the second flanges to leave the flange gasket between the face of the first flange and the face of the second flange.

11. The method of claim 10 wherein:

the gasket holding element further comprises a pair of retention holes which also extend entirely through the gasket holding element in the transverse direction on opposite sides of the bolting slot;

the retention holes are positioned in alignment with two other of the bolt holes of the first flange;

the gasket holding element is temporarily secured on the face of the first flange in step (a) by inserting a pair of locking pins through said two other of the bolt holes of the first flange into the retention holes of the gasket holding element to releasably lock the gasket holding element in position on the face of the first flange; and the gasket holding element is released in step (e) by unlocking the pair of locking pins and withdrawing the pair of locking pins from the retention holes of the gasket holding element and from said two other of the bolt holes of the first flange.

12. The method of claim 11 wherein in step (a) a pair of locking pin sleeves are inserted into said two other of the bolt holes of the first flange and the pair of locking pins are received through the pair of locking pin sleeves.

13. The method of claim 10 wherein:

the gasket holding element comprises at least two of the bolting slots, each of the bolting slots extends rearwardly into the holding element from the forward edge, the bolting slots are parallel, each of the bolting slots has an open forward end at the forward edge, and each of the bolting slots extends entirely through the holding element in the transverse direction perpendicular to the gasket groove;

in steps (a) and (b), the two bolting slots are positioned in alignment with a pair of the bolt holes of the first flange and a corresponding pair of the bolt holes of the second flange; and in step (c), a pair of bolts are inserted through the pair of the bolt holes of the first flange, the two bolting slots of the gasket holding element, and the pair of the bolt holes of the second flange.

14. The method of claim 10 wherein the first flange and the second flange are raised face flanges.

15. The method of claim 10 wherein the first flange and the second flange are flat faced flanges.

* * * * *